US005537125A

United States Patent [19]

Harrell, Jr. et al.

[11] Patent Number: 5,537,125

[45] Date of Patent: Jul. 16, 1996

[54] TELESCOPING TOWER

[75] Inventors: Roy L. Harrell, Jr., Greenville; Lawrence V. Behr, Washington, both of N.C.

[73] Assignee: LBA Technology, Inc., Greenville, N.C.

[21] Appl. No.: 315,262

[22] Filed: Sep. 29, 1994

[51] Int. Cl.[6] ..... H01Q 1/12

[52] U.S. Cl. ..... 343/878; 343/880; 343/883; 343/888; 248/188.5; 52/110; 52/118

[58] Field of Search ..... 343/711, 874, 343/875, 878, 880, 881, 883, 888, 889, 890; 248/159, 188.5, 519; 52/110, 111, 117, 118, 121; H01Q 1/12

[56] References Cited

U.S. PATENT DOCUMENTS

| | | | |
|---|---|---|---|
| 1,899,742 | 2/1933 | Bay | 52/118 |
| 2,795,303 | 6/1957 | Muehlhouse et al. | 52/121 |
| 2,942,700 | 6/1960 | Parmenter et al. | 52/121 |
| 3,047,107 | 7/1962 | Parmenter et al. | 52/121 |
| 3,103,375 | 9/1963 | McMullin | 248/188.5 XR |
| 3,267,625 | 8/1966 | Holzschuh et al. | 52/111 |
| 3,284,972 | 11/1966 | Werner | 52/118 |
| 3,361,456 | 1/1968 | Durand | 52/118 |
| 3,688,455 | 9/1972 | Zebuhr | 343/883 X |
| 3,738,075 | 6/1973 | Nansel | 52/118 X |
| 3,985,234 | 10/1976 | Jouffray | 52/118 X |
| 4,254,423 | 3/1981 | Reinhard | 343/883 |
| 4,483,109 | 11/1984 | MacDonald et al. | 52/118 X |
| 4,587,526 | 5/1986 | Ahl, Jr. | 343/883 |
| 4,658,266 | 4/1987 | Doty, Jr. | 343/848 |
| 4,772,894 | 9/1988 | Foissac et al. | 343/890 X |
| 4,871,138 | 10/1989 | Sauter | 52/118 X |
| 4,932,176 | 6/1990 | Roberts et al. | 52/118 |
| 5,101,215 | 3/1992 | Creaser, Jr. | 343/883 |
| 5,163,650 | 11/1992 | Adams et al. | 343/883 X |
| 5,218,375 | 6/1993 | Hillman | 343/883 |
| 5,228,251 | 7/1993 | Frigon | 52/118 X |
| 5,426,444 | 6/1995 | Sauter et al. | 343/883 |

FOREIGN PATENT DOCUMENTS

| | | | |
|---|---|---|---|
| 0002152 | 1/1977 | Japan | 343/883 |
| 0574802 | 9/1977 | U.S.S.R. | 343/883 |

*Primary Examiner*—Donald T. Hajec
*Assistant Examiner*—Steven Wigmore
*Attorney, Agent, or Firm*—Rhodes, Coates & Bennett

[57] ABSTRACT

A transportable broadcast antenna supported on a moveable carriage comprising a telescoping tower having plurality of nesting sections, including an outer section, and intermediate and inner sections, each section slidable relative to the adjacent exterior tower section between retracted, deployed and release positions, and latches to hold the section in the deployed position. The latches disengage when the section is further extended to the release position, and is prevented from locking when the tower is retracted. Radials join the tower and extending outwardly therefrom.

17 Claims, 4 Drawing Sheets

TELESCOPING TOWER

BACKGROUND OF THE INVENTION

The present invention relates to a telescoping tower formed of a plurality of nesting sections, including an inner section, an outer section, and generally one or more intermediate sections, with the inner and intermediate sections being slidable relative to an adjacent exterior section between a nested or retracted position, a deployed or locked position, and a release position. The tower of the present invention is especially suitable for use as part of a transportable broadcast antenna. Of particular importance to the present invention is a latch or locking mechanism which allows the tower sections to be locked and unlocked by an operator from ground level.

Various telescoping towers have been described in the prior art. For example, U.S. Pat. No. 3,361,456 to Durand describes a telescoping tower, such as a crane tower, having a locking system in which support arms on an inner tower section extend outwardly to rest on beating surfaces on an adjacent tower section when the tower is extended, and are pivoted away from the bearing surfaces to allow the tower to be lowered. The arms initially extend downward. When the tower is deployed, the arms are moved above the bearing surfaces, and are pivoted outward by contact with pins. The inner tower is then lowered so that the arms rest on the surfaces to hold the inner section in the extended position. When the tower is to be lowered, the inner section is further extended to contact the arms with pins, pivoting the arms downward, and allowing the inner section to be lowered without the arms contacting the beating surfaces.

U.S. Pat. No. 1,899,742 to Bay describes a locking mechanism for an extension ladder having a triangular inner section which telescopes from a triangular outer section. The mechanism comprises pivotal hooks which are cammed away from the ladder rung on their upward movement, and then engage a rung when lowered. To release the latch, the inner ladder section is extended further upward, to close fingers over the hooks, preventing their engagement with a rung on the downward movement.

U.S. Pat. No. 4,254,423 to Reinhard describes a locking mechanism for an antenna mast. The antenna is formed of a plurality of nested, telescoping sections which are deployed by hydraulic or pneumatic means. In the fully extended position, spring loaded lever arms extend into recesses to hold the section is a upright position. To release the locking mechanism, the operator pulls on a rope to pivot the lever arms out of the recesses by forcing a camming surface against the arms.

U.S. Pat. No. 4,483,109 to MacDonald et al describes an emergency latching system for a telescoping boom comprised of a pivotal latch plate which engages a slot in an adjacent inner section of the boom if the telescoping chain breaks.

U.S. Pat. No. 5,228,251 to Frigon describes a telescoping mast which may be used to support an antenna. The nested sections of the mast may be locked in an extended position with tabs which are bent inwardly to engage the bottom of the adjacent inner section. To retract a mast section, the inner section is raised and the tab is bent outwardly to remove it from the path of the inner section.

U.S. Pat. No. 3,284,972 to Werner describes a telescoping antenna tower comprised of a plurality of nesting triangular sections. The Werner tower is assembled horizontally while on the ground and then raised into position. Sections are held in the extended position by locking pins.

U.S. Pat. No. 4,932,176 to Roberts et al describes a transportable, telescoping antenna carried on the back of a track. The antenna is pivoted from a horizontal position to a vertical position by hydraulic means. The antenna sections are extended by a cable extending around a series of pulleys, with the cable being pulled by a winch, and are held in the extended position by cable tension.

U.S. Pat. No. 5,101,215 to Creaser describes a telescoping tower comprised of a plurality of nesting triangular sections that are extended by retracting a single cable running from the top of each section to the bottom of the adjacent inner section, and then up to the top of that section.

U.S. Pat. No. 4,871,138 to Sauter describes a telescoping tower in which each inner section is locked in the extended position by a latching mechanism including a locking pin which is cammed into a slot in the adjacent outer section, and withdrawn when the tower is lowered.

U.S. Pat. No. 5,163,650 to Adams et al describes a latching mechanism involving the use of a rotatable disk which is rotated into locking position beneath a bar on the adjacent inner section to lock the sections in an extended position, and then rotated to unlock the sections.

While the above and other telescoping towers are described in the prior art, there is still a need for a tower comprised of telescoping sections which can be securely latched in the deployed position, and then released from ground level by the operator. A latching mechanism which will support high loads and levels of stress is also desired, as is a latching mechanism which will provide a greater contact area between tower sections, and thus improved conductivity, when the tower is used as a broadcast antenna.

SUMMARY OF THE INVENTION

These and other aspects are achieved by the present invention which relates to a telescoping tower which can be mounted on a wheeled carrier, and in particular to a telescoping tower including a latch to lock adjacent tower sections in a secure deployed position, that may be subsequently released, by the operator from ground level. The tower may be used as a broadcast antenna, as well as for other purposes.

The present tower is comprised of an outer tower section and an inner tower section. In most instances the tower will also include one or more intermediate tower sections between the outer and inner sections. The outer tower section has the largest cross-section, and the other sections have progressively smaller cross-sections, so that the sections can be nested. Preferably, the cross-section of the tower is triangular, although other cross-sections, e.g., rectangular, are contemplated by the present invention.

Each tower section has at least three outer surfaces and is preferably constructed of at least three parallel, spaced rods or robes, e.g., positioned at the comers of an equilateral triangle, with cross braces joining adjacent robes to form a rigid structure. The tubes and cross-braces are preferably formed of aluminum for weight considerations. The tubes, and thus the tower sections, may be of any length, although a length of from about 15 to about 20 feet is preferred to minimize the number of sections required to meet the desired tower height, while providing ease of transportation.

When transportation of the tower to different locations is desired, the tower sections are mounted on a wheeled carrier, e.g., a trailer, which includes a tower support bed to hold the tower in a horizontal position. The outer tower section is joined near its lower end to the trailer with a hinge, allowing the tower to be pivoted between a horizontal position for transportation, and a vertical position for deployment and use. An actuator, such as a hydraulic or pneumatic piston joins the trailer and the tower to move the tower between horizontal and vertical positions. The trailer may also include storage cabinets to store radials, antenna tunig equipment, a transmitter, and other components during transportation, a trailer hitch to join the trailer to a vehicle, and adjustable stabilizers to prevent the trailer from tipping when the tower is extended.

When the tower is deployed, the intermediate and inner tower sections will each be extended by sliding the section, along with any sections nested inside the section, upwardly from inside the adjacent exterior tower section to an extended or deployed position, where the section will be secured to the adjacent outer section by a latch to be described hereinafter. When the section is to be retracted, the section will be further extended beyond the deployed position to a release position, where the latch will be released and disabled. The section will then be lowered to its nested position.

Preferably, the tower sections are deployed, or retracted as the case may be, in a sequential fashion, with the outermost intermediate section being deployed first, followed sequentially by the next outermoste intermediate section, and finally the inner section, until all intermediate sections and the inner section are extended. During retraction the inner section is retracted first, followed by retraction of the intermediate sections, beginning first with the innermost intermediate section. It is within the scope of the invention, however, to simultaneously deploy or retract all, or a plurality, of the sections.

A powered or manually operated control means is provided to extend and retract the tower sections. Since it is contemplated that the present invention will be used under circumstances requiring rapid and manual deployment by a limited number of personnel, and under conditions where machinery requiting complex repair procedures is to be avoided, the control means is desirably as simple to operate and repair as possible.

Thus, the preferred control means is comprised of a set of ropes or cables extending from the lower end of the inner and each intermediate section, over the top of the adjacent exterior section, and then downward toward the bottom of the tower, where they can be reached by the operator. In order to reduce friction, the ropes may extend through pulleys attached to the tops of the outer and intermediate sections.

The operator pulls on each rope in sequence to raise the attached tower section, beginning with the outermost intermediate section and ending with the inner section. A winch or other means, preferably manually operated, may be used to assist in pulling or releasing the ropes. To lower a given section, the operator pulls on the rope attached to the section to raise the section above the latched position to the release position, and then feeds the rope out to lower the section to its retracted position.

The inner tower section and each intermediate tower section is secured to the adjacent tower section when in the extended position by a latch which can be released by the operator from the ground. This latch is comprised of a latch receiving member mounted at the top end of each intermediate or outer section, and a latching member mounted at the bottom end of the inner and each intermediate section. When a latch receiving member or latching member is described herein as being mounted "at" the top or bottom end of a tower section, as the case may be, it is meant that the member is positioned within about 3 feet or so of the top or bottom end of the section. Generally, the member should be positioned from about 1 foot to about 2 feet from the end of the section.

Each latch receiving member including an upper latch deflecting surface, a lower latch deflecting surface, and a latch receiver, e.g., a latch receiving slot between these surfaces. As used herein the term "slot" includes an opening through the receiving member as well as a recess into the member. Preferably, the latch receiving member includes a shoulder or latch plate supporting surface adjacent the interior of the slot along its lower edge to aid in guiding the plate and to act as a pivotal support for the latch plate when adjacent tower sections are latched together in the deployed position.

The latch receiving member may be formed of an upper plate that overlaps a lower plate which is attached along the upper portion of its outer face to the lower portion of the inner face of the upper plate. In this configuration, the upper plate will include a horizontal, upper latch deflecting surface and a slot or cut-out section. The lower plate will includes a horizontal, upper latch deflecting surface or shoulder extending rearwardly from the lower edge of the slot or notch. Lower plate will also include a horizontal latch deflecting surface along its lower edge.

The latching member includes a latch plate, a latch plate connector, a latch support to mount the latch plate and connector on the tower section, and a spring or other means to urge the latch plate in a normally horizontal, outwardly extending attitude. The latch plate is movable between a ready position, a latched position and a release position. The latch support may be in the form of a cylindrical, horizontal support robe or rod extending between corner robes of a tower section, and the connector may be a sleeve encircling the rod, and slidable around it. The latch plate preferably extends radially from the connector, with an inner end integral with the connector, e.g., welded thereto, and a free outer end positioned to engage the surfaces of the latch receiving member.

In order to prevent the intermediate and inner tower sections from moving inwardly past their nested positions, outwardly projecting restraining plates may be attached to the tops of the inner and intermediate sections, so that the plates contact the top edges of the adjacent exterior tower section. An antenna mast may be connected to the top of the inner section. Guy wire attachments, such as eyelets, may be attached to the tops of the tower sections so that upper ends of guy wires can be attached to the towers and extended to anchors or attachment points at ground level to secure the tower in an upright position.

During deployment or retraction of the sections, the outer surface of the tower section being moved will necessarily contact the inner surface of the adjacent exterior tower, resulting in wear and abrasion. Normally, this contact is between the upright tubes of the tower being moved and the cross braces of the adjacent tower section. To minimize the effect of this contact, it is desirable to position a contact means such as rollers or guide shoes at locations on the tower sections where this contact may occur.

When the tower is to be used as an antenna, it is constructed of a metal, e.g., aluminum, or other conductive material. A connector is provided for attaching a cable from the transmitter. Copper ground radials may be attached to the tower and extend radially outward along the ground therefrom During deployment, a nested tower section is extended upwardly. When the latching mechanism reaches the latch receiving member, the latch plate is pivoted downwardly due to contact with the member's lower surface. Upon further extension, the front edge of the latch plate rides along the inner face of the latch receiving member until passing the shoulder and engaging the slot. The operator lowers the tower section to seat the latch plate fully into the slot, and then releases the pull on the rope, whereby the weight of the tower section is supported on the latch plate, with both faces of the latch plate contacting the latch receiving member.

When the tower section is to be retracted, the operator pulls on the rope to further extend the tower section, withdrawing the latch plate from the slot. The front edge of the latch plate then slides upwardly along the inner face of the latch receiving member until reaching the member's upper surface where it is release from engagement with the latch receiving member. The latch plate is then urged to the horizontal position.

The operator then begins to lower the tower section. When the latching member reaches the latch receiving member, the latch plate contacts the member's upper surface and is pivoted upward, and in held in the upward position by the inner face of plate during further lowering, thereby preventing the plate from being inserted into the slot during retraction.

Figure 1:
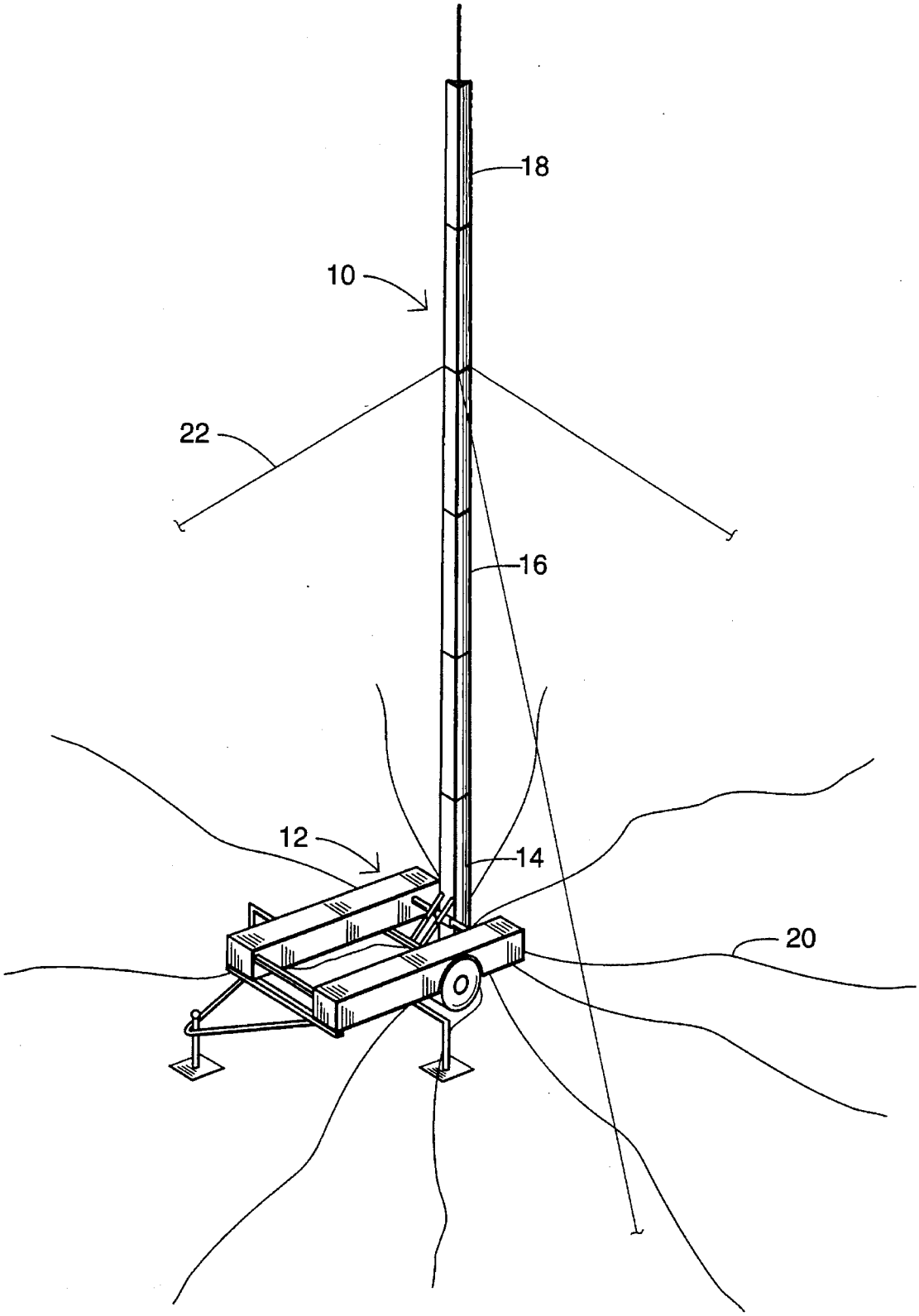
FIG. 1 is a perspective view of the broadcast antenna with the tower in a vertical, deployed state, and radials extended.

FIGS. *9a–9f* are diagrammatic side views showing the cooperation between a latch receiving member and a latching member at various stages of deployment, latching and retraction.

DETAILED DESCRIPTION OF THE PREFERRED EMBODIMENT

In the following description, terms such as horizontal, upright, vertical, above, below, beneath, and the like, are used solely for the purpose of clarity in illustrating the invention, and should not be taken as words of limitation. Similar reference characters are used to identify corresponding parts.

As best shown in FIG. 1, the antenna of the present invention is comprised of a multi-sectional, telescoping tower, generally 10, which is pivotally mounted on a wheeled trailer, generally 12, for transportation in a horizontal position, and deployment in a vertical position. Tower 10 is comprised of an outer or lower section 14, intermediate sections 16, and an inner or upper section 18. Radials 20 are attached to the lower end of tower 10 and extend radially therefrom. Guy wires 22 are provided to secure tower 10 in the vertical position.

Figure 2:
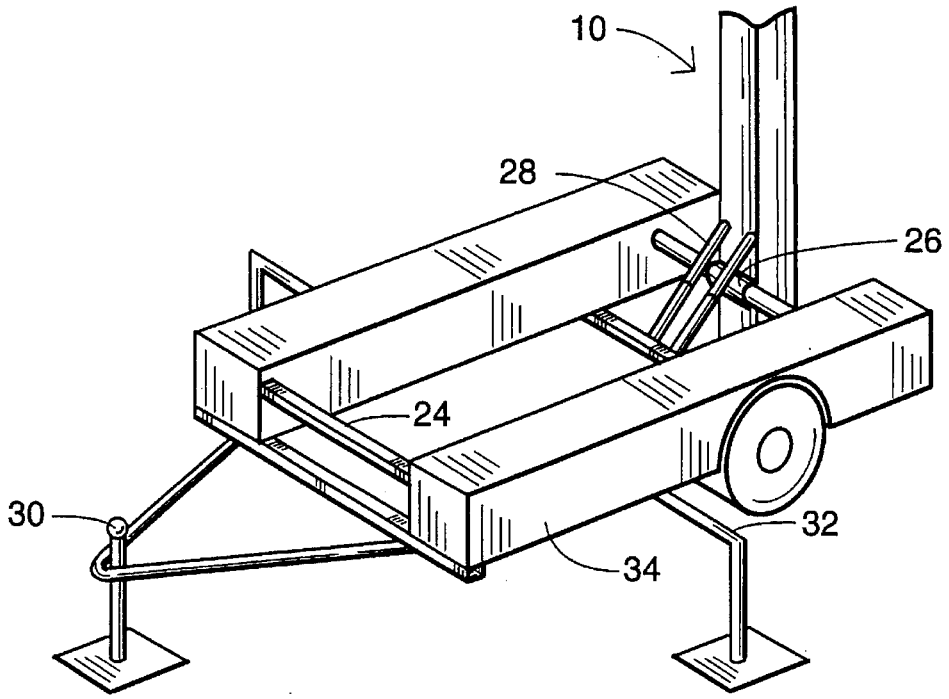
FIG. 2 is a perspective view of the tower in a vertical, deployed state on a wheeled trailer.
Figure 3:
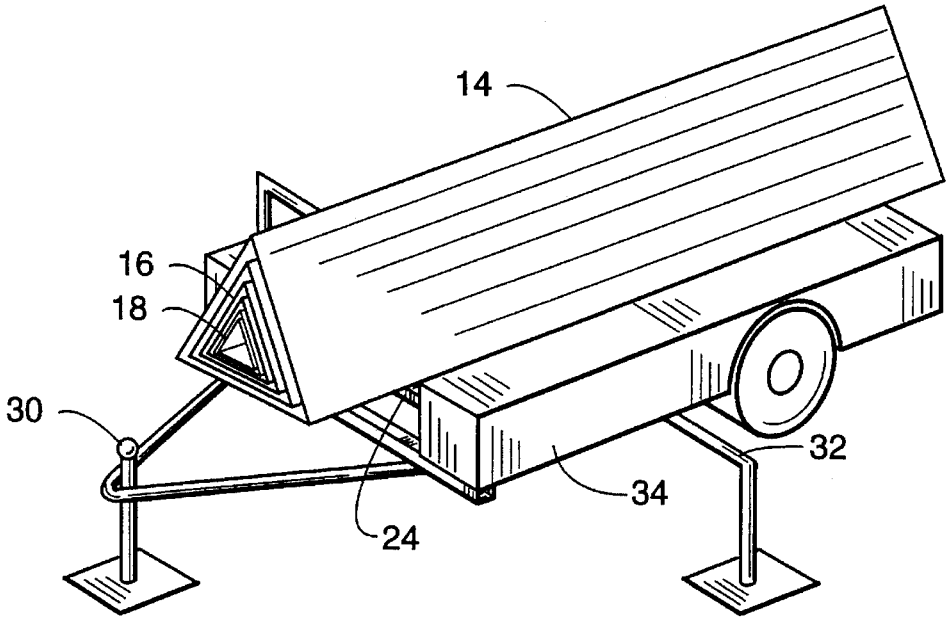
FIG. 3 is a perspective view of the tower in a retracted, horizontal, stowed state on a wheeled trailer.

FIG. 2, illustrates the tower on a trailer in the vertical, deployed position, with the tower attached to trailer bed 24 with hinge 26, and extended hydraulic pistons 28 have one end attached to bed 24 and the opposite end attached to the outer tower section 14. Trailer 12 also includes a hitch 30, retractable and adjustable stabilizers 32, and storage boxes 34. When tower 10 is stowed for transportation, as best shown in FIG. 3, intermediate sections 16 and inner section 18 are nested within outer section 14, and the sections are supported horizontally on bed 24.

Figure 4:
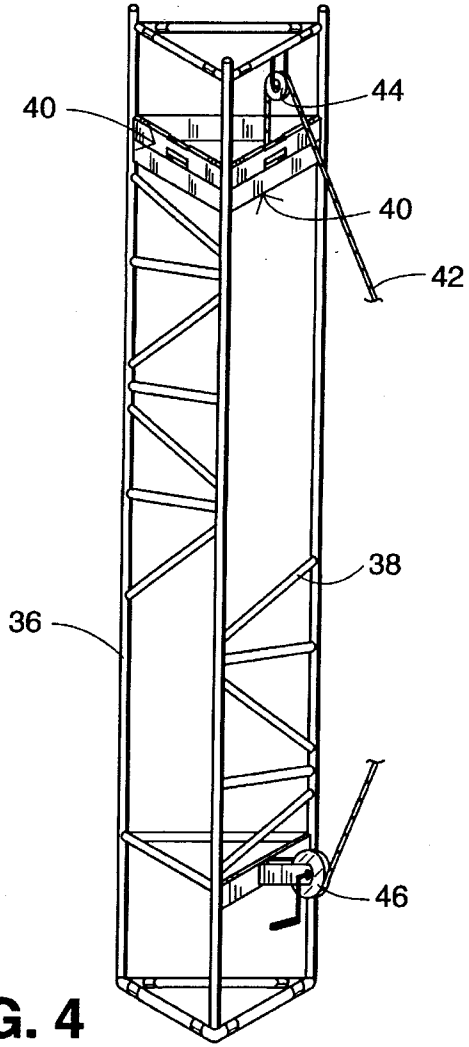
FIG. 4 is a perspective view of the outer tower section with some cross-braces removed for clarity.

Outer tower section 14, illustrated in FIG. 4, the cross-section of which is in the shape of an equilateral triangle, is comprised of three comer tubes 36, joined by cross-braces 38, partially removed for clarity. Latch receiving members, generally 40, are horizontally positioned near the top edge of section 14, with their ends attached to corner tubes 38. A rope 42 extends over a pulley 44 attached to the top of tower section 14. Rope 44 has an inner end extending down to the bottom of the intermediate tower section adjacent section 14, where it is attached. The opposite free end of rope 44 extends outside the tower and down to an operator at ground level. A manually powered winch 46 is mounted on the outside of tower section 14 near the bottom of the tower where it can be conveniently reached by the operator.

Figure 5:
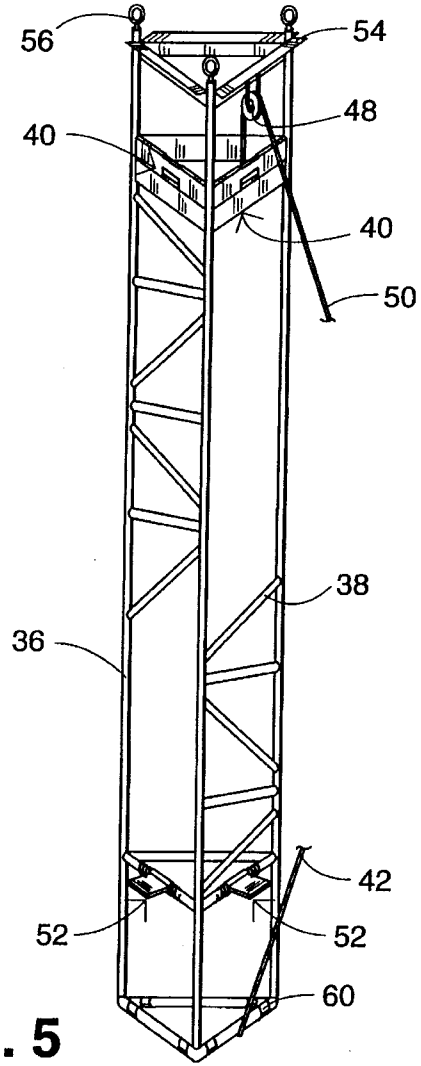
FIG. 5 is a perspective view of an intermediate tower section with some cross-braces removed for clarity.

Intermediate tower section 16, shown in FIG. 5, also includes three corner tubes 36 and latch receiving member 40 adjacent its upper end extending between corner robes 36, which are of the same construction as the corresponding elements of section 14. The cross-section of section 16 is less than that of section 14, so that section 16 will nest within section 14. Section 16 also includes a pulley 48 attached to its upper end and a rope 50 extending from the lower end of the adjacent tower section inside section 16, which may be another intermediate section or the inner tower section, through the pulley and downwardly outside the tower to the operator.

Tower section 16 also has latching members 52 attached adjacent the bottom of the tower section beneath latch receiving members 40. Horizontal stops 54 extend outwardly from the upper edges of section 16 to engage the upper ends of the adjacent exterior section when section 16 is retracted, preventing section 16 from moving into the adjacent section beyond the nested position. Guy wire attachment means 56 are fitted at the upper corners of section 16 to facilitate attachment of guy wires 22.

Figure 6:
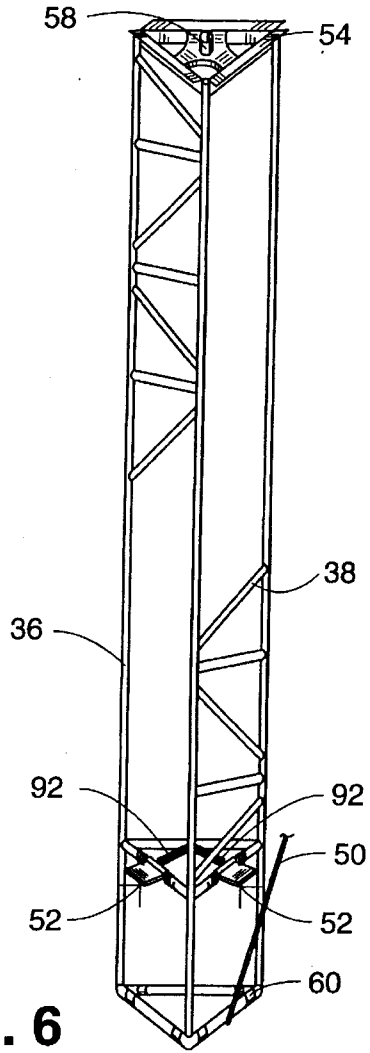
FIG. 6 is a perspective view of the inner tower section with some cross-braces removed for clarity.

Inner tower section 18, shown in FIG. 6, is also comprised of three parallel corner robes 36 and cross-braces 38. A pair of latching members 52 are horizontally positioned between corner tubes adjacent the lower end of tower section 18. An antenna mount 58 is attached to the top of section 16, to facilitate attachment of an antenna, not shown. Section 18, like section 16, has horizontal stops 54 at the top to limit the distance section 18 can be inserted within the adjacent exterior section.

All sections of the tower include guide shoes 60, at least on the cross-braces to reduce friction and wear resulting from contact of adjacent tower sections. Guide shoes 60 are preferably made of a low friction material, such as Teflon.

Figure 7:
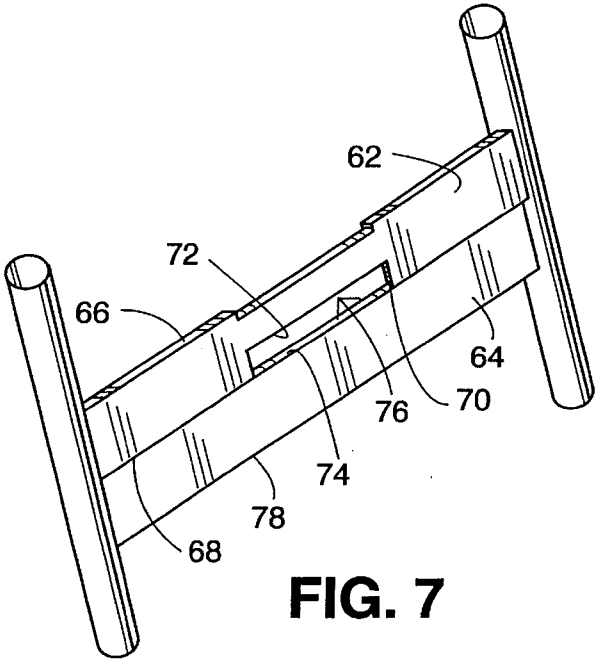
FIG. 7 is a perspective view of the latch receiving member.

Each latch receiving member 40, shown in detail in FIG. 7, is comprised of an upper plate 62 and a lower plate 64, which overlap, with the lower, inner face of plate 62 being joined to the upper, outer face of plate 64. Upper plate 62 includes a horizontal, upper latch deflecting surface 66, and a horizontal lower edge 68, with a cut-out section or notch 70 therein which has a horizontal upper surface 72. Lower plate 64 includes a horizontal, upper latch deflecting surface or shoulder 74 extending rearwardly from the lower edge of notch 70. Notch 70 and shoulder 74 together form latch receiving slot 76. Lower plate 64 also includes a lower, horizontal latch deflecting surface 78, formed by the lower edge of plate 64. Surfaces 66, 72, 74 and 78 may be radiused, i.e., rounded, to facilitate latch deflection, insertion and removal.

Figure 8:
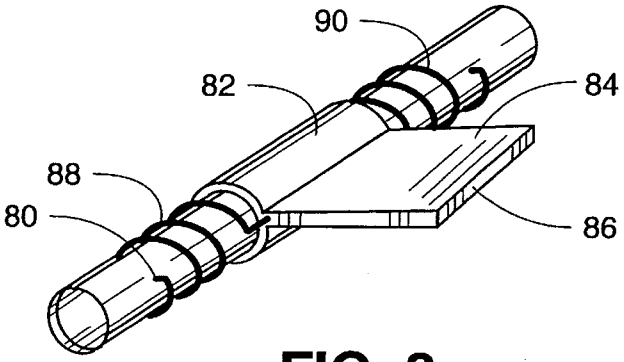
FIG. 8 is a perspective view of the latching member.

Latching member 52, shown in detail in FIG. 8, comprises a cylindrical, horizontal support bar 80 extending between tubes 36, and a connector sleeve 82, slidable around bar 80. A rectangular latch plate 84 has its inner end joined to sleeve 82, and a radiused, free end or forward edge 86 extending away from sleeve 82. Springs 88 and 90 join sleeve 82 to bar 80 to urge latch plate 84 to a normally horizontal attitude. Other means may be used to urge plate 84 to the normal horizontal attitude. For example, FIG. 6 illustrates the use of springs 92 extending from the rear of the sleeve member to a central point connected to an opposed tower cross brace.

FIGS. 9*a*–9*f* diagrammatically illustrate the different relationships of latching member 52 and latch receiving member 40 during deployment, release and retraction of adjacent tower sections, in which latching member 52 is supported on an interior tower section and latch receiving member 40 is supported on an adjacent, exterior tower section in a position to be engaged by latch plate 84.

Figure 9F:
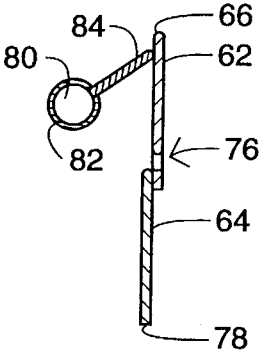
Figure 9E:
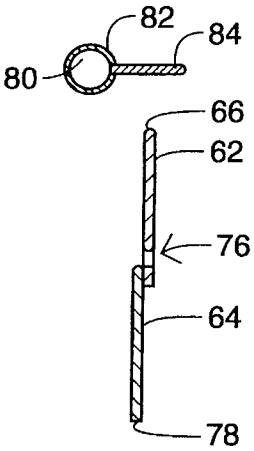
Figure 9D:
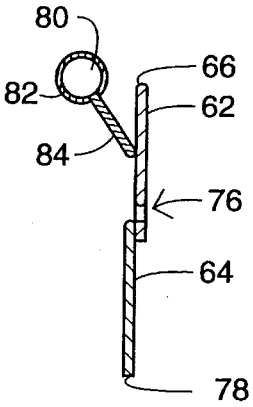
Figure 9C:
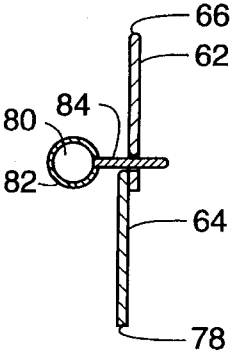
Figure 9B:
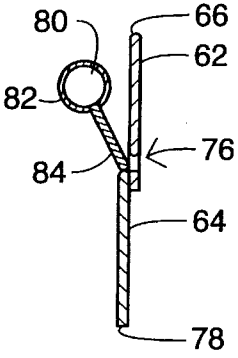
Figure 9A:
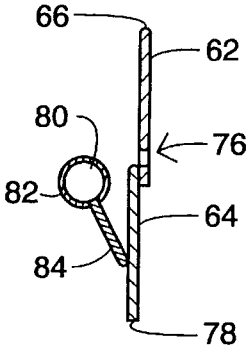

Specifically, FIG. 9*a* shows initial contact of latch plate 84 with plate 64 pivoting plate 84 downwardly. FIG. 9*b* shows plate 84 immediately after passing shoulder 74 in front of slot 76. FIG. 9*c* shows latch plate 84 engaged in slot 76 with the upper face of plate 84 engaging surface 72 and the lower face of plate 84 engaging shoulder 74. FIG. 9*d* shows latch plate 84 against the inner face of plate 62 as the inside tower is moved to the release position. FIG. 9*e* shows latch plate 84 at the release position, where plate 84 is released from contact with latch receiving member 40 and again moves to the horizontal position. FIG. 9*f* shows the relationship of plate 84 and latch receiving plate 62 at the initiation of retraction of the inside tower, immediately after latch plate 84 engages surface 66, which pivots plate 84 upwardly to prevent insertion of plate 84 into slot 76 during retraction.

In operation, trailer 12 with tower 10 supported thereon in a horizontal position is pulled to the desired destination. Stabilizers 32 are set in place, and hydraulic jacks 28 are extended, e.g., by a hydraulic pump, not shown, to pivot tower 10 about hinge 26, moving tower 10 to a vertical attitude. The outer end of rope 42 is then attached to winch 46, which is turned by the operator to raise the outermost intermediate tower section and all of the sections within it from inside outer tower section 14. When latching member 52 reaches the level of latch receiving member 40, latch plate 84 contacts lower surface 78, causing plate 84 to pivot downwardly. The front edge 86 of latch plate 84 then rides along the inner face of plate 64 until reaching shoulder 74.

Plate 84 is then released from contact with plate 64 and moves under the influence of springs 92 into engagement with plate 62 with front edge of latch plate 84 being adjacent slot 76. The operator then lowers section 18 slightly to seat latch plate 84 fully into slot 76, with the upper face of plate 84 contacting surface 72 and the lower face of plate 84 contacting shoulder 74, thus providing a large contact area between the sections. The operator then unwinds, or releases, rope 42 from winch 46, whereby the weight of tower section 16 and the interior tower sections supported on latch plate 84.

The next intermediate tower section 16 and the remaining interior sections are then raised in a similar manner by pulling on the rope attached to the bottom of the section, extending over pulley 46. Latching member 52 and latch receiving member 40 cooperate as described above. This procedure is repeated for all intermediate sections, progressing from the exterior of the tower to the interior. Finally, interior section 18 is raised in a similar manner by pulling on rope 50.

When the tower is to be retracted, beginning with inner section 18, the operator connects rope 50 to winch 46 and further extends inner tower section 18 to withdraw latch plate 84 from slot 76. Front edge 86 of plate 84 moves from slot 76 and rides upwardly along the inner face of plate 62 until reaching upper surface 66. After passing surface 66, latch plate 84 is urged to the horizontal position by springs 88 and 90. The operator then begins to release rope 50, lowering section 18. Latch plate 84 is pivoted upward by contact with upper surface 66, and in held in the upward position by the inner face of plate 62, thereby preventing plate 84 from engaging slot 76 during retraction. This procedure is repeated for all intermediate sections sequentially from the interior to the exterior of the tower until all sections have been retracted.

In the preferred embodiment illustrated in the drawings, two latches are used to connect adjacent tower sections, providing additional contact surface, and an extra degree of safety. The above description applies to the operation of all latches, with all latches joining a given pair of tower sections operations simultaneously. The present invention is applicable to towers having one latch per section pair, as well as to towers having more than two latches per section pair.

Also, the above description is for a tower comprising an inner section, an outer section, and one intermediate section. It is within the scope of the invention to provide towers formed of only an inner section and an outer section, as well as towers with an inner section, an outer section and more than one intermediate section. In the case of towers with more than one intermediate section, the same steps will be followed during the deployment and retraction of each intermediate tower section.

In order to ensure stability of the tower, guy wires 22 are preferably attached at the tops of each section to wire attachments 56, before deployment of the section, and are extended to ground anchors away from the tower. When the tower is to be used as a broadcast antenna, the outer tower section will also include means to attach a transmitter cable, and radials will be connected to the tower and extended radially along the ground away from the tower.

Certain modifications and improvements will occur to those skilled in the art upon a reading of the foregoing description. By way of example, the latch described herein can be used to lock sections of towers other than broadcast antennas. The tower can also be transported on other vehicles, or even mounted at a stationary location. Also, the latching member can be positioned on an exterior tower section, and the latch receiving member on an adjacent interior tower section. It should be understood that all such modifications and improvements have been deleted herein for the sake of conciseness and readability but are properly within the scope of the follow claims.

What is claimed is:

1. A telescoping tower comprising:

a) an outer section having an upper end and a lower end;

b) an inner section having an upper end and a lower end positioned within said outer section, said inner section being moveable between a retracted position, a deployed position and a release position;

c) a latch receiving member positioned at the upper end of said outer section, said latch receiving member having a horizontal upper edge, a horizontal lower edge spaced below said upper edge, and a latch receiving slot between said edges; and d) a latching member positioned at the lower end of said inner section, said latching member including a pivotal latch plate having a free end toward said outer section and positioned to engage and be pivoted downward by said horizontal lower edge when said inner section is moved from said retracted position to said deployed position, and positioned to engage and be pivoted upward by the horizontal upper edge when the inner section is moved from a release position to said retracted position, said plate extended into said slot when said inner section is in the deployed position.

2. The tower of claim 1 wherein said latching member further includes a horizontal latch plate support secured to said inner tower section, a latch plate connector joining said latch plate to said latch plate support, and a spring urging said latch plate to a horizontal position toward said outer section.

3. The tower of claim 2, wherein said latch plate support comprises a horizontal cylinder, and said latch plate connector comprises a sleeve around said cylinder, said latch plate having an inner edge attached to said sleeve.

4. The tower of claim 1, wherein said latch receiving member further includes a shoulder along the bottom of said slot toward said latching member.

5. The tower of claim 1, wherein said latch receiving member comprises an upper, outer plate with a horizontal upper edge, and a lower edge including a latch receiving notch; and an lower, inner plate with horizontal upper and lower edges; the lower part of said upper plate overlapping and being attached to the upper part of said lower plate to form a latch receiving slot defined by said upper plate notch and said lower plate upper edge and a shoulder toward said latching member.

6. The tower of claim 1, wherein said first tower section includes at least three spaced, parallel tubes, and cross braces joining said tubes, with said latching member extending between two of said tubes at the upper part of said tower, and said adjacent tower section includes at least three spaced, parallel tubes, and cross braces joining said tubes, with said latch receiving member extending between two of said tubes at the lower part of said tower.

7. The tower of claim 1, wherein said sections have a triangular cross-section.

8. A telescoping tower comprising a) an outer section including a first latch receiving member at its upper end;

b) an intermediate section slidable within said outer section between retracted, deployed and release positions, said intermediate section including a second latch receiving member at its upper end, and a first latching member at its lower end beneath said latch receiving member; and c) an inner section slidable within an intermediate section between retracted, deployed and extended positions, said inner section having a second latching member at its lower end; each of said latch receiving members including an upper latch deflecting edge, a lower latch deflecting edge, and a latch plate receiving slot between said edges; and each of said latching members including a pivotal latch plate having a free end positioned to engage and be pivoted downward by the lower deflecting edge of the latch receiving member on the adjacent outer section when the section supporting said latching member is moved from the retracted position to the deployed position, and positioned to engage and be pivoted upward by the horizontal upper edge of the latch receiving member on said adjacent outer section when the section supporting said latching member is moved from the release position to the retracted position, said plate extending into the receiving slot of the latch plate receiving member on the adjacent outer section when the section supporting said latching member is in the deployed position.

9. The tower of claim 8, wherein said intermediate and inner sections each further include a latch plate support, and a spring urging said latch plate to a horizontal position toward said outer section.

10. The tower of claim 8, further including a base, a hinge joining said outer tower to said base, whereby said tower is pivotal between a horizontal position and a vertical position, and a hydraulic jack to move said tower between horizontal and vertical positions.

11. The tower of claim 10, wherein said base is wheeled.

12. The tower of claim 8, wherein said inner section includes an antenna mount at its top end.

13. The tower of claim 8, further including means for sequentially moving said intermediate and inner sections between extended and retracted positions.

14. The tower of claim 13, wherein said means comprises pulleys at the upper end of said outer and intermediate sections, pull ropes extending from the bottom of said inner and intermediate sections over the pulleys on adjacent outer sections, and a winch to sequentially engage said ropes.

15. The tower of claim 8, wherein at least one of said tower sections further include guide shoes to separate said section from contact with an adjacent section.

16. A transportable broadcast antenna comprising a) a telescoping tower including an outer section having an upper end and a lower end; an inner section having an upper end and a lower end positioned within said outer section, said inner section being moveable between a retracted position, a deployed position and a release position; a latch receiving member positioned at the upper end of said outer section, said latch receiving member having a horizontal upper edge, a horizontal lower edge spaced below said upper edge, and a latch receiving slot between said edges; a latching member positioned at the lower end of said inner section, said latching member including a pivotal latch plate having a free end toward said outer section and positioned to engage and be pivoted downward by said horizontal lower edge when said inner section is moved from said retracted position to said deployed position, and positioned to engage and be pivoted upward by the said horizontal upper edge when said inner section is moved from said release position to said retracted position, said plate extended into said slot when said inner section is in the deployed position;

b) a wheeled trailer having a tower support bed, a hinge pivotally joining the outer section of said tower to said trailer, and a tower positioning means to move said tower between horizontal and vertical positions; and c) radials joining said tower and extending outwardly therefrom.

17. The antenna of claim 16, wherein said latches form a conductive connection between said tower sections when said tower is in the deployed position.

* * * * *